US010745086B2

(12) United States Patent
Teixeira et al.

(10) Patent No.: US 10,745,086 B2
(45) Date of Patent: Aug. 18, 2020

(54) MOORING CONNECTOR ASSEMBLY

(71) Applicant: BALLTEC LIMITED, Morecambe (GB)

(72) Inventors: Marco Andre Teixeira, Morecambe (GB); Jonathan Scott Preston, Preston (GB); Jonathan Fletcher Jackson, Poulton-le-Fylde (GB); William David Loton Parry, Preston (GB)

(73) Assignee: BALLTEC LIMITED, Morecambe, Lancashire (GB)

( * ) Notice: Subject to any disclaimer, the term of this patent is extended or adjusted under 35 U.S.C. 154(b) by 0 days.

(21) Appl. No.: 16/075,551

(22) PCT Filed: Feb. 3, 2017

(86) PCT No.: PCT/GB2017/050278
§ 371 (c)(1),
(2) Date: Aug. 3, 2018

(87) PCT Pub. No.: WO2017/134457
PCT Pub. Date: Aug. 10, 2017

(65) Prior Publication Data

US 2019/0039691 A1 Feb. 7, 2019

(30) Foreign Application Priority Data

Feb. 4, 2016 (GB) ..... 1602041.4

(51) Int. Cl.
*B63B 21/10* (2006.01)
*B63B 21/18* (2006.01)
(Continued)

(52) U.S. Cl.
CPC ..... *B63B 21/08* (2013.01); *B63B 21/10* (2013.01); *B63B 21/18* (2013.01); *B63B 21/50* (2013.01);
(Continued)

(58) Field of Classification Search
CPC ..... B63B 21/08; B63B 22/021; B63B 21/50; B63B 21/18; B63B 21/10; B63B 2021/007; B63B 22/04; B63B 21/04
(Continued)

(56) References Cited

U.S. PATENT DOCUMENTS 9,604,704 B2 * 3/2017 Lisland ..... B63B 21/18
9,840,309 B2 * 12/2017 Lisland ..... B63B 21/50
(Continued)

FOREIGN PATENT DOCUMENTS

GB 2496860 A 5/2013
RU 2128124 C1 3/1999
(Continued)

OTHER PUBLICATIONS

International Search Report for PCT/GB2017/050278 dated May 31, 2017; 4 pages.

*Primary Examiner* — Anthony D Wiest
(74) *Attorney, Agent, or Firm* — Schwabe Williamson & Wyatt, PC

(57) ABSTRACT

A mooring connector assembly (3) has a body (10) arranged to be pivotally mounted to a structure (1), such as a tethered buoy, to be moored for movement about a pivot axis. At least a part of the body extends below the pivot axis when so mounted and oriented for use. A line stopper (17) is mounted to the part of the body which extends below the pivot axis in use and is operative to retain a mooring line (2) relative to the body. The body is configured to receive a tensioner (20) for tensioning a mooring line (2) retained by the stopper such that the tensioner urges the line at a point which is below the pivot axis when the body is oriented for use. The body may be an elongate tube (10) pivotally connected to a structure to be moored (1) at one end and fitting with a chain stopper (17) at the opposite end. The tube is configured to
(Continued)

receive a chain tensioner (20) between the chain stopper (17) and pivot axis.

12 Claims, 11 Drawing Sheets

(51) Int. Cl.
*B63B 22/02* (2006.01)
*B63B 21/00* (2006.01)
*B63B 21/08* (2006.01)
*B63B 21/50* (2006.01)

(52) U.S. Cl.
CPC ..... *B63B 22/021* (2013.01); *B63B 2021/007* (2013.01)

(58) Field of Classification Search
USPC ..... 114/256, 264, 265, 266, 267; 441/1, 3
See application file for complete search history.

(56) References Cited

U.S. PATENT DOCUMENTS

| | | | | |
|---|---|---|---|---|
| 2012/0160146 | A1 | 6/2012 | Miller | |
| 2014/0026796 | A1* | 1/2014 | Leverette | B63B 21/00 114/230.24 |
| 2014/0224163 | A1 | 8/2014 | Zijlmans | |
| 2015/0000579 | A1* | 1/2015 | Pontaut | B63B 21/04 114/230.3 |

FOREIGN PATENT DOCUMENTS

| | | | |
|---|---|---|---|
| WO | 2013/043049 | A1 | 3/2013 |
| WO | 2013/088082 | A2 | 6/2013 |
| WO | 2017/134457 | A1 | 8/2017 |

* cited by examiner

MOORING CONNECTOR ASSEMBLY

CROSS-REFERENCE TO RELATED APPLICATION

The present application is a national phase entry under 35 U.S.C. § 371 of International Application No. PCT/GB2017/050278, filed Feb. 3, 2017, entitled "MOORING CONNECTOR ASSEMBLY," which designates the United States of America, which claims priority to GB Application No. 1602041.4, filed Feb. 4, 2016, the entire disclosures of each of these applications are hereby incorporated by reference in their entireties and for all purposes.

TECHNICAL FIELD OF THE INVENTION

The present invention relates to a mooring connector assembly, particularly although not exclusively, for a tethered buoy.

BACKGROUND TO THE INVENTION

It is known to use subsea buoys in hydrocarbon production facilities. These buoys are tethered to the seabed with mooring chains in order to maintain them in a desired position. The chains are connected to the buoys by way of connector assemblies which can accommodate a chain tensioner to enable the tension in a mooring chain connected to the connector assembly to be adjusted.

A connector assembly is disclosed in GB 2496860. The assembly comprises a support mounted to a subsea buoy. A lever member is mounted to the support by way of a flex joint allowing the lever to move relative to the support about a pivot axis. A chain stop mechanism is mounted to the support below the pivot axis. A frame rests on and extends above the support and a sheave is mounted to the frame at a position above the pivot axis. In use a chain extends from the sea bed into the chain stop mechanism, up through the lever member and over the sheave with the free end of the chain hanging down from the sheave. A chain tensioning unit may be supported on top of the support, at a position above the pivot axis, and arranged to tension the chain to enable tension in the chain to be adjusted.

The chain stop mechanism prevents downward movement of the chain through the lever member and so, in normal use, maintains tension in the chain between the sea bed and the buoy. The flex joint allows the lever member to pivot relative to the buoy under tension in the chain so that the chain extends in a substantially straight path from the seabed to the chain stop mechanism as the buoy moves relative to the sea bed, thus avoiding undesirable stress concentrations in the chain.

When it is desired to adjust tension in the chain a chain tensioner unit is placed onto the support. The chain tensioner unit includes jacks which engage with the chain extending from the lever member to the sheave in order to tension the chain and draw it up through the chain stop mechanism to either increase tension in the chain between the chain stop mechanism and the sea bed or, by taking load off the chain stop mechanism allowing it to be released, to decrease tension by allowing chain to pass downwardly through the chain stop mechanism.

A problem has, however, been found with the assembly in that when the chain tensioner unit takes up load on the chain undesirable stress concentrations can build up in the chain. Since the chain tensioner unit is in a fixed position relative to the support the chain may no longer extend in a substantially straight path between the point at which it is supported (i.e. the chain tensioner unit) and the sea bed. Additionally, the chain may no longer extend in a straight path from the chain tensioner unit and the lever member which can make it difficult to disengage the chain tensioner and/or cause damage to the lever member. These issues cause additional wear on the chain, potentially leading to its premature failure.

Embodiments of the present invention have been made in consideration of these problems.

SUMMARY OF THE INVENTION

According to a first aspect of the present invention there is provided a mooring connector assembly comprising:

a body arranged to be pivotally mounted to a structure to be moored for movement about a pivot axis, at least a part of the body extending below the pivot axis when so mounted and oriented for use, and a stopper mounted to the part of the body which extends below the pivot axis in use and operative to retain a mooring line relative to the body, wherein the body is configured to receive a tensioner for tensioning a mooring line retained by the stopper such that the tensioner urges the line at a point which is below the pivot axis when the body is oriented for use.

Since both the stopper and tensioner are arranged to hold a mooring line at a point beneath the pivot axis is use, when tension is maintained in the line either by the stopper or tensioner that tension will cause the body to pivot about the pivot axis so that the line is substantially straight. This reduces stress concentrations in the line.

The part of the body which extends below the pivot axis in use may be configured to receive a tensioner, in particular it may comprise a formation and/or fitting for supporting a tensioner. The body may be configured to receive a tensioner in a position between the stopper and the pivot axis when the body is oriented for use.

The body may be an elongate member. The body may be a tube.

One end of the elongate member may be arranged to be pivotally mounted to a structure. The stopper may be mounted to the opposite end of the body.

The body may define an internal space through which a mooring line extends, in use. Where the body comprises a tube the line may extend through the tube.

The body may comprise one or more openings into the internal space through which a tensioner may extend in use. The or each opening may be an elongate slot.

One or more line management structures may be mounted to the body. One structure may be a sheave, wheel or slide for guiding the free end of mooring line extending from the stopper or a tensioner. The line may be a chain. In this case the body may comprise surfaces defining a cruciform space through which the chain may run. The stopper may be a chain stopper.

The mooring connector assembly may further comprise a bracket to be mounted to a structure to be moored and the body may be pivotally mounted to the bracket. One of the body and bracket may comprise one or more trunnions and the other one or more bearings for receiving the or each trunnion. The bracket may be arranged to be pivotally mounted to a structure to be moored. The bracket may be arranged to pivot through a first axis relative to the structure and the body may be arranged to pivot through a second axis relative to the bracket. The first and second axes may be substantially perpendicular.

A line tensioner may be mounted to the connector assembly and arranged to tension a mooring line retained by the stopper by urging the line at a point which is below the pivot axis when the body is oriented for use. The line tensioner may be a chain jack.

According to another aspect of the invention there is provided subsea buoy having a connector assembly according to the first aspect of the invention mounted thereto.

DETAILED DESCRIPTION OF THE INVENTION

In order that the invention may be more clearly understood an embodiment thereof will now be described, by way of example only, with reference to the accompanying drawings, of which:

Figure 1:
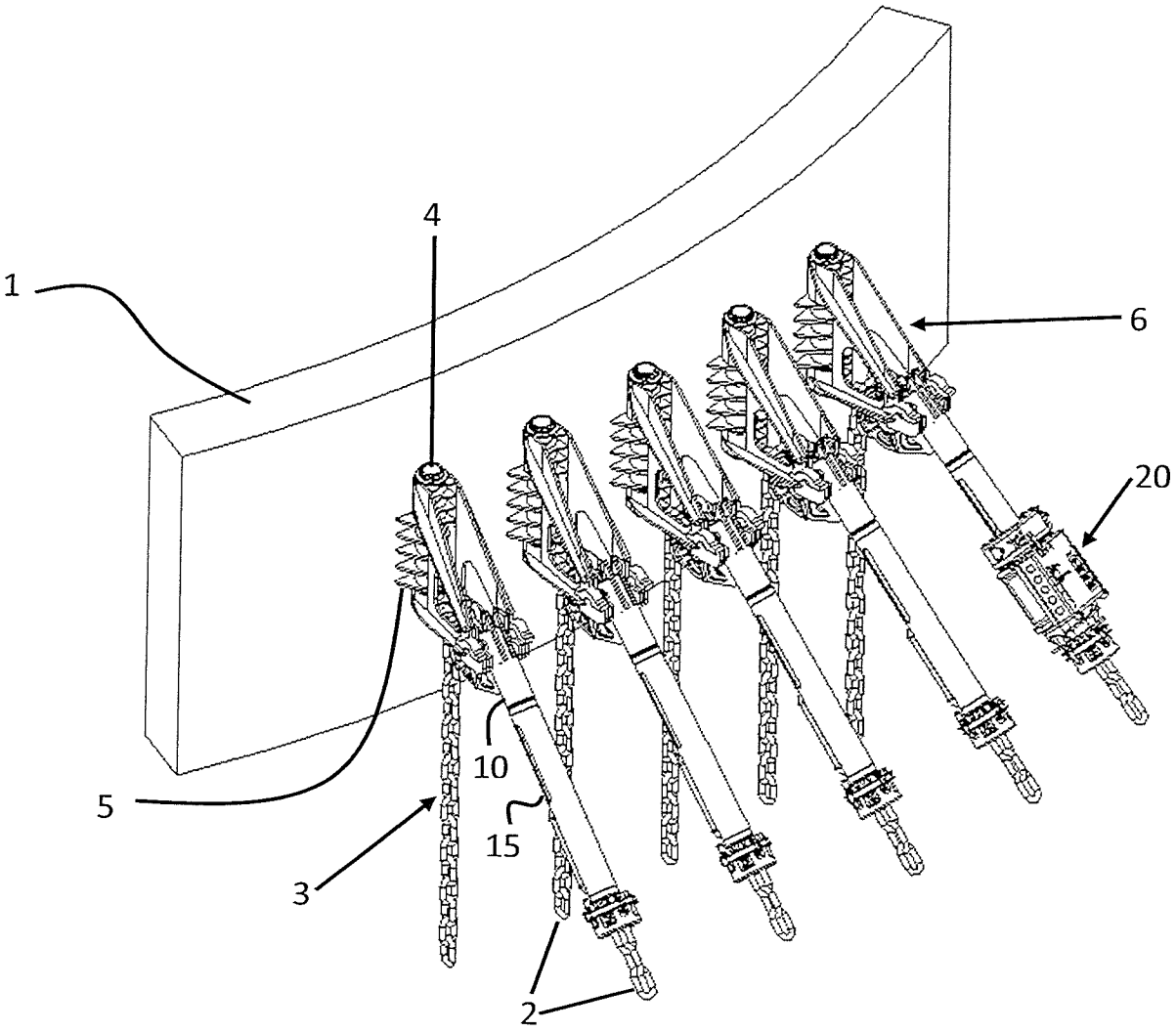
FIG. 1 shows part of a subsea buoy fitted with mooring connector assemblies.
Figure 2:
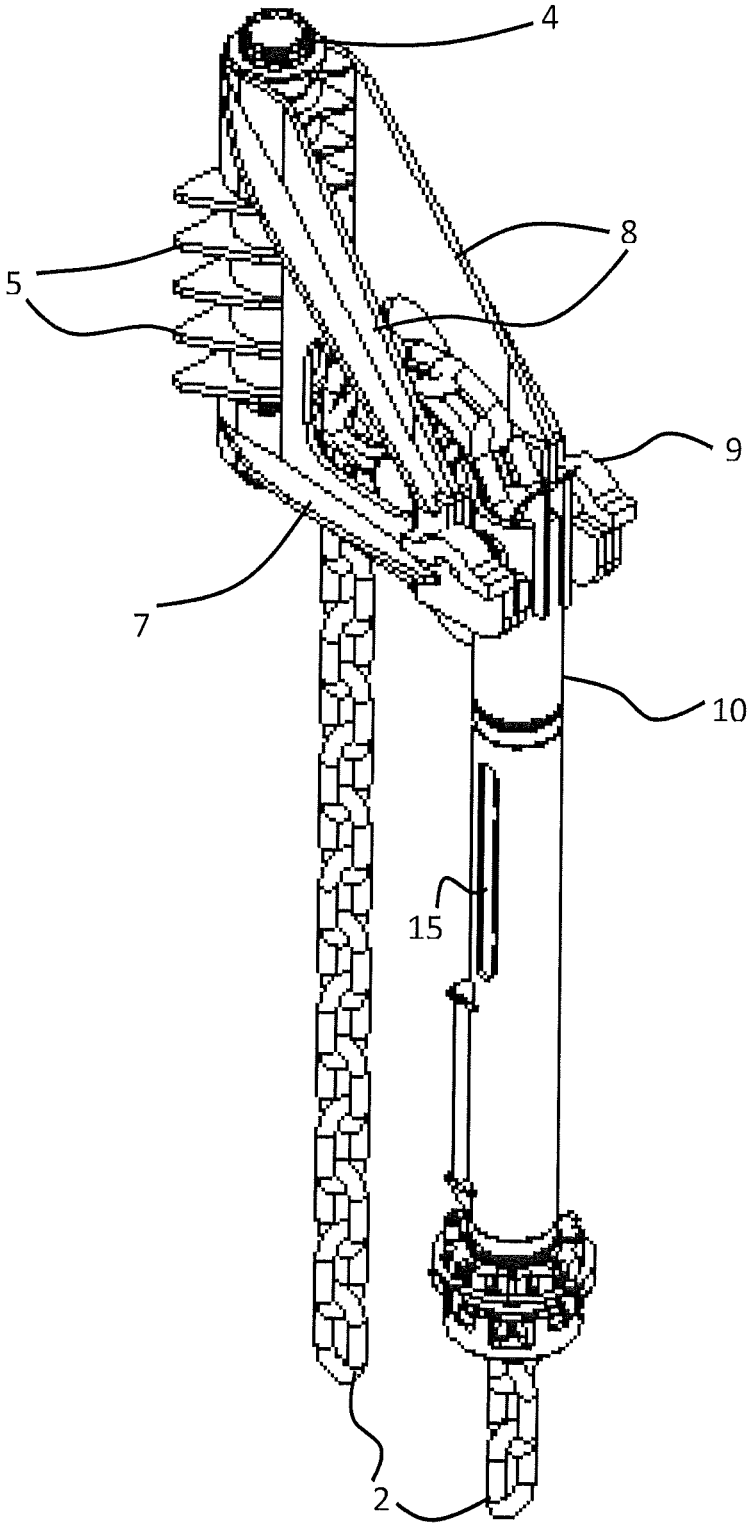
FIG. 2 is a perspective view of one of the mooring connector assemblies of FIG. 1.
Figure 3:
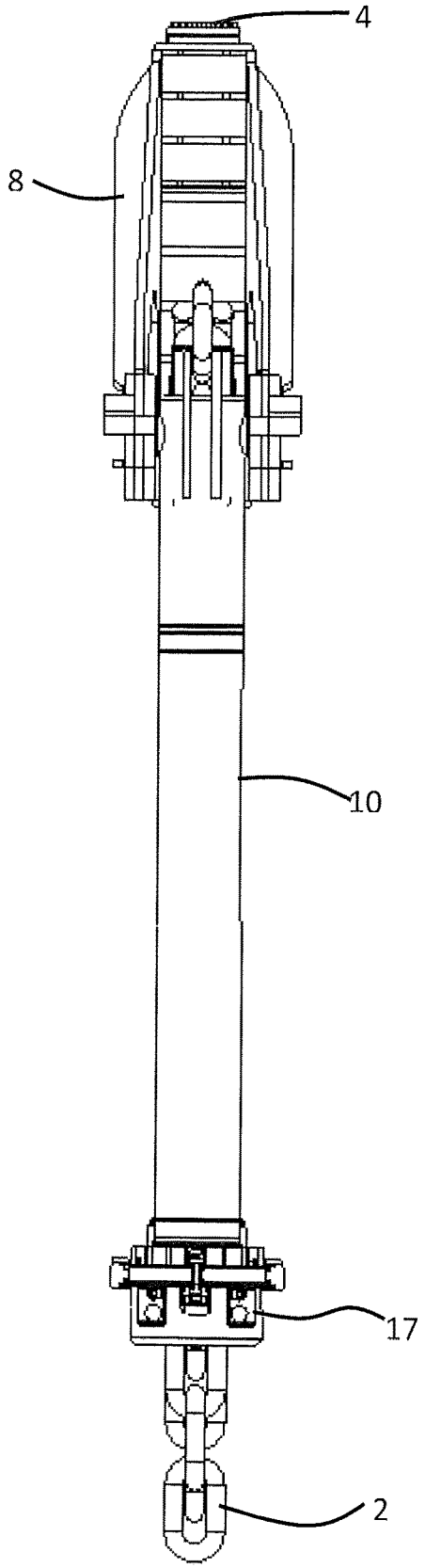
FIG. 3 is an end elevation of the assembly of FIG. 2.
Figure 4:
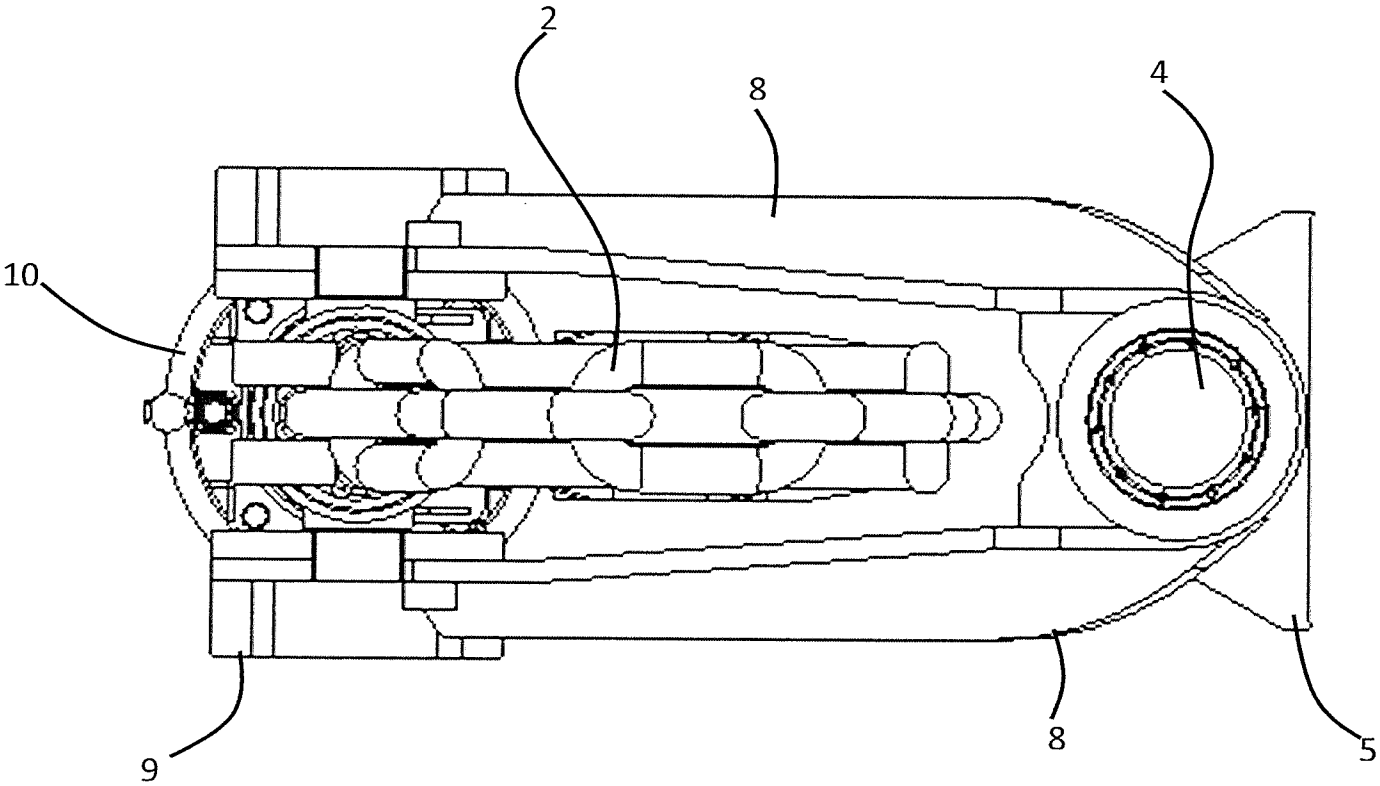
FIG. 4 is a plan view of the assembly of FIG. 2.
Figure 5:
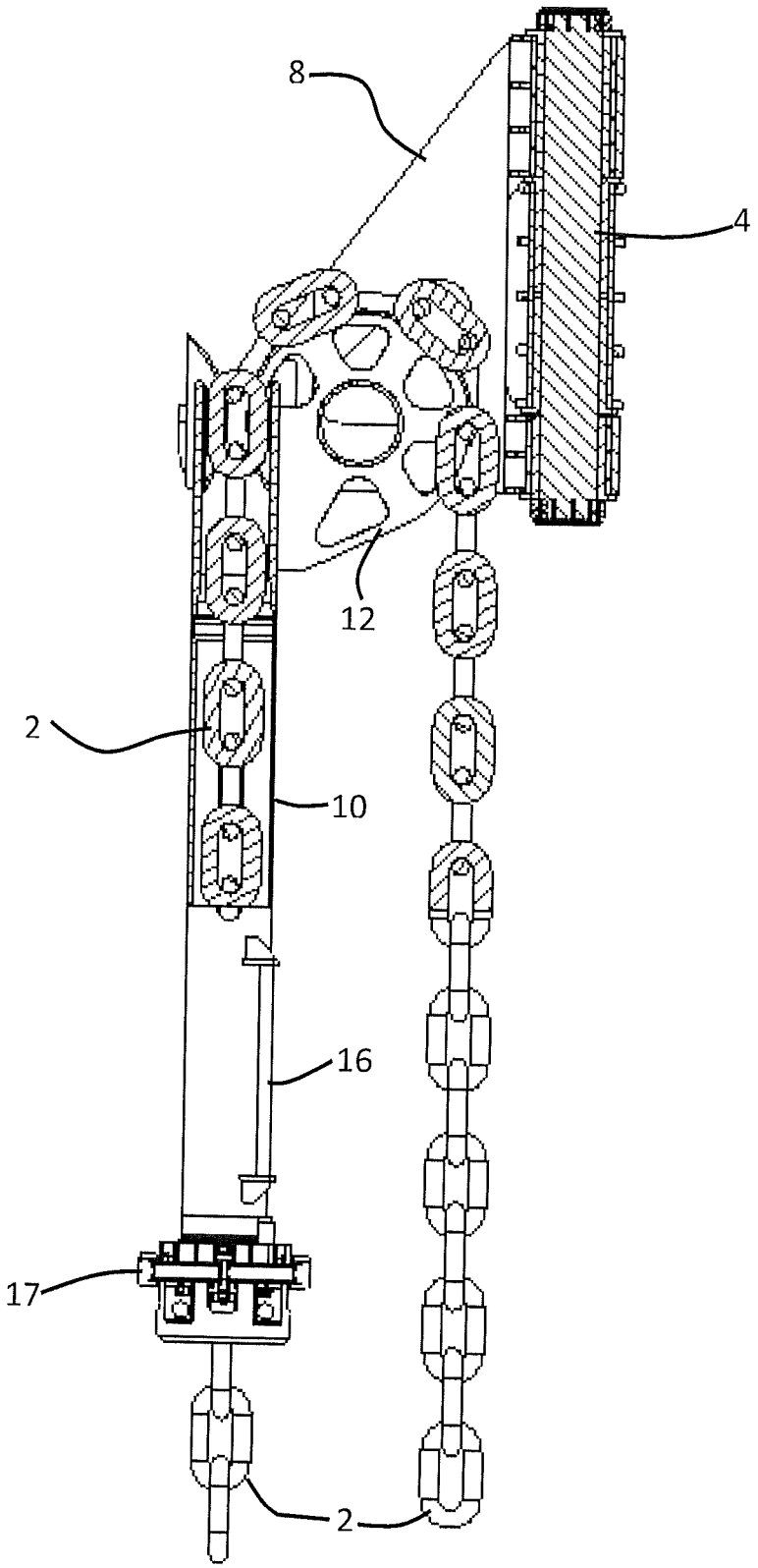
FIG. 5 is a partially cut away side elevation of the assembly of FIG. 2.
Figure 6:
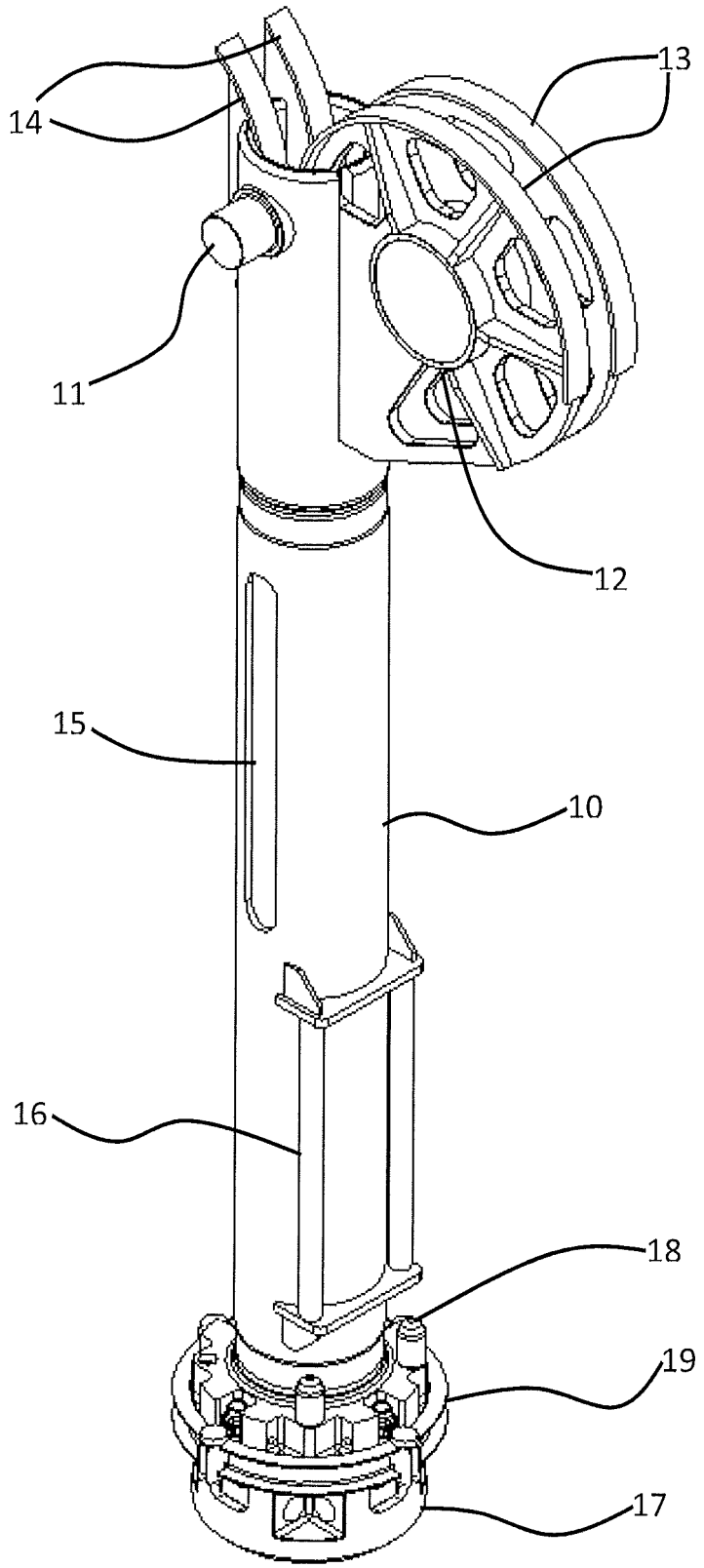
FIG. 6 is a perspective view of part of the assembly of FIG. 3 with chain removed.
Figure 7:
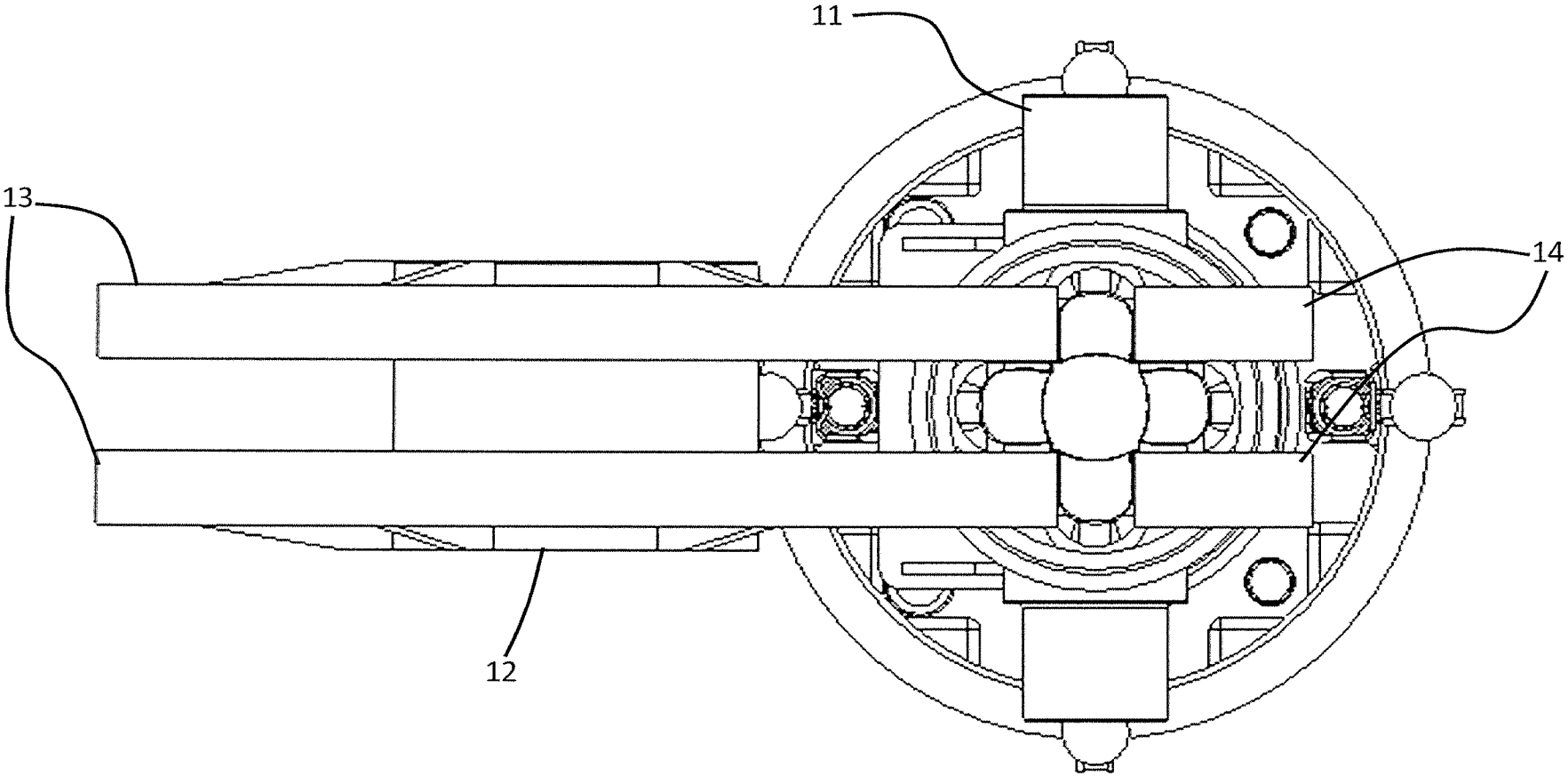
FIG. 7 is a plan view of the apparatus of FIG. 6.
Figure 8:
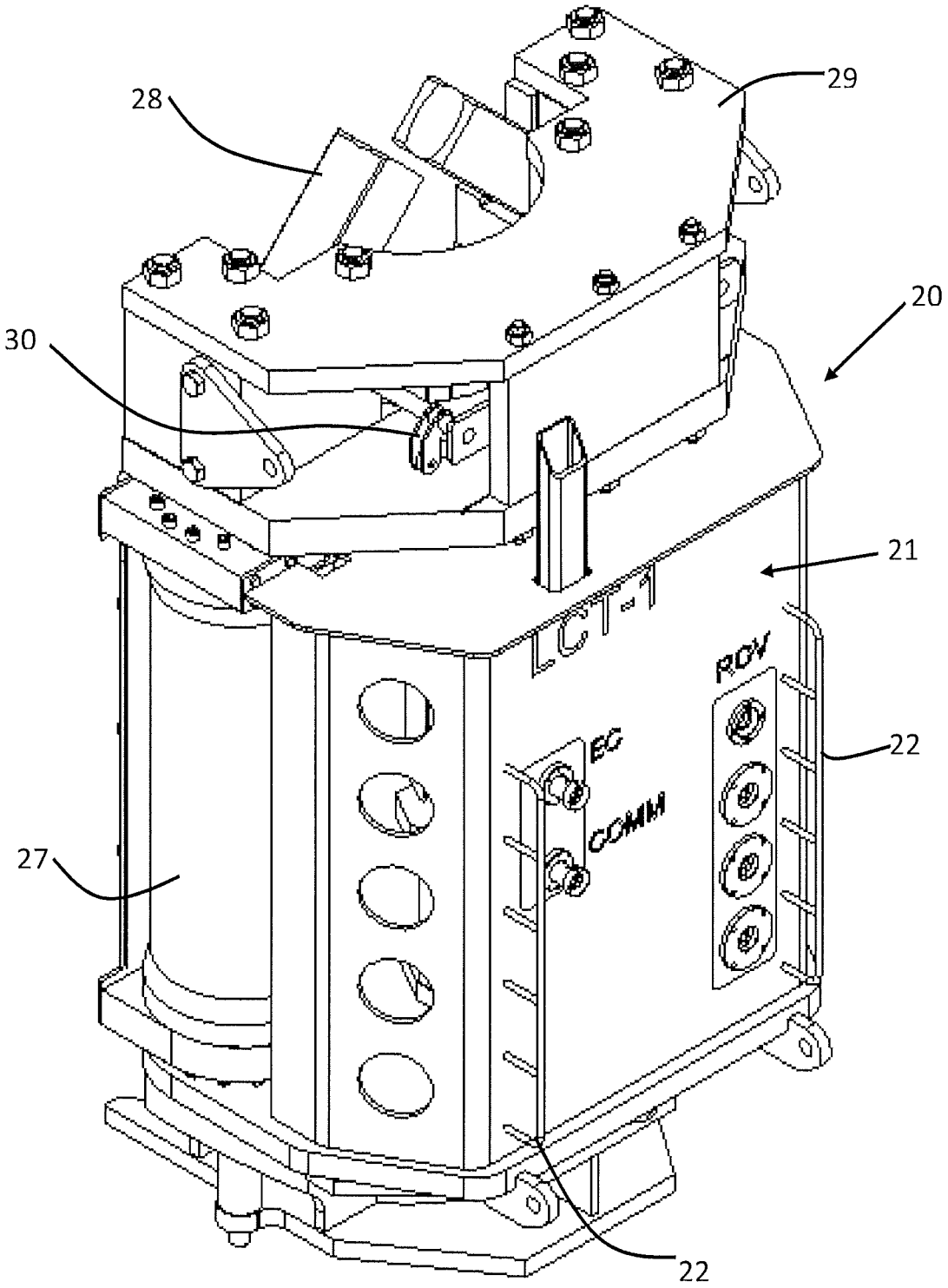
FIG. 8 is a perspective view of a chain tensioner.
Figure 9:
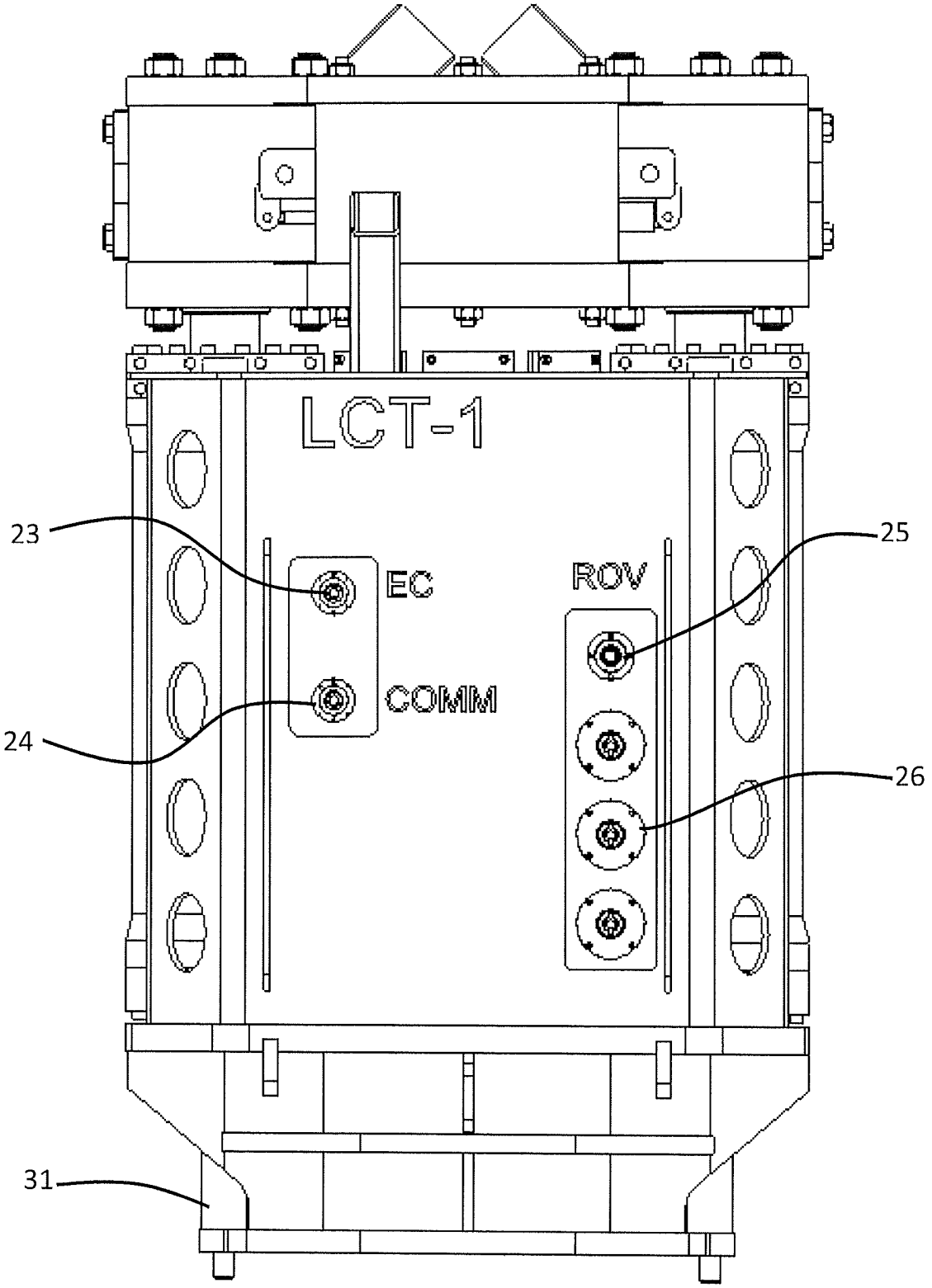
FIG. 9 is an end view of the chain tensioner of FIG. 8.

In the following the terms up, down, top, bottom and like terms are used to describe the apparatus in the orientation in which it is depicted in FIGS. 2 to 11 of the drawings but are not intended to be otherwise limiting. In use, the apparatus will typically adopt the orientation shown in FIG. 1.

Referring to the drawings, a subsea buoy 1 or other midwater structure (which may take any suitable form) is secured in position relative to the sea bed by a plurality of mooring chains 2. The mooring chains extend from suitable anchorages on or near the sea bed (not shown) to mooring connector assemblies 3 mounted to the buoy.

Each mooring connector assembly comprises a generally cylindrical pivot pin 4. The pivot pin 4 is mounted to a side of the buoy, in a upright orientation, by a series (five in illustrated embodiment) of plates 5 spaced evenly along part of the length of the pin. The plates 5 encircle the pin 4, to which they are welded or otherwise fastened, and have an edge which matches the external surface of the buoy and is welded or otherwise fastened to the buoy so as to mount the pivot pin in a position spaced from the surface of the buoy with the pin extending both above the uppermost plate 5 and below the lowermost plate.

A bracket 6 is pivotally mounted to the pin 4 for partial rotation about the pin. The bracket comprises a lower pair of arms 7 which extend generally horizontally out from a bearing mounted to the part of the pin 4 projecting below the mounting plates 5, and an upper pair of arms 8 which form tension struts extending diagonally from a bearing mounted to the part of the pin 4 projecting above the mounting plates 5 to a position near the free end of the lower arms 7. A pair of generally horizontally disposed bearings 9 are provided at the free end of the lower arms 7.

An elongate downtube 10 is suspended from the bracket. Trunnions 11 are provided on opposite sides of downtube close to its top end and received into the bearings 9 on the bracket 6 thus enabling the downtube to pivot about a horizontal axis relative to the bracket 6. A chain support 12 is mounted to the outside of the top end of the downtube 10 so that, in use, it extends between the two lower arms 7 of the bracket 6. The chain support provides two spaced apart, parallel, convex arcuate surfaces 13 extending from just within the top of the downtube 10 radially away from the axis of the downtube in an upright plane. The surfaces extend through approximately 180 degrees. Diametrically opposite these surfaces 13 within the top of the downtube 10 are a second pair of arcuate, convex chain support surfaces 14 which mirror surfaces 13 but extend through a smaller angle. Within the downtube the four surfaces 13, 14 define a cruciform space through which, in use, the mooring chain extends.

Two diametrically opposed elongate slots 15 are formed through the wall of the downtube. The slots extend parallel to the axis of the downtube from a position below the chain support 12 to a position about midway along the length of the downtube. Each slot 15 is positioned beneath one of the trunnions 11.

Two, spaced apart, substantially parallel guide rods 16 are mounted on the outside surface of the downtube 10, spaced from the surface of the downtube and extending generally parallel to the axis of the downtube from a position below the elongate slots 15 to a position spaced above the bottom of the downtube.

A one chain link resolution chain stopper 17 is mounted to the bottom of the downtube. The chain stopper 17 is of a size greater than the diameter of the downtube and the upper surface of the chain stopper supports two positioning pins 18.

The chain stopper 17 comprises chain dogs which are arranged to allow chain 2 to pass through the stopper upwardly into the downtube 10 but not to pass in the reverse direction. The chain stopper 17 comprises a release lever 19 which is operable to release the chain dogs (when the load of the chain has been removed from them) to permit chain to pass downwardly through the stopper out of the downtube.

In use a mooring chain 2 extends from an anchor point up through the chain stopper 17, through the downtube 10, out of the top of the downtube and over the chain support 12 with its free end hanging down from the chain support 12. As the chain stopper prevents chain passing downwardly out of the downtube 10 it keeps the chain under tension between the mooring connector assembly and the anchor point. Bearings 9 on the bracket and the bearings on the pivot pins 4 allow the downtube to pivot about two substantially perpendicular axes with tension in the chain, so that the chain maintains a substantially straight path between the anchor point and the chain stopper. Mass of the free end of the chain 2 hanging from the chain support 12 keep the region of chain between the chain stopper 17 and chain support 12 under tension, but far less tension than the region extending from the chain stopper 17 to the anchor point. The chain 2 is held in a fixed rotational position relative to the downtube 10 by the chain stopper 17, and in the same fixed rotational position relative to the downtube by the cruciform space formed by the chain support surfaces 13 and 14 at the top of the downtube 10, with the result that the chain within the downtube 10 is supported in a fixed rotational orientation relative to the downtube.

When it is desired to adjust tension in the chain a chain tensioner 20 is deployed. The chain tensioner comprises a body 21 arranged to be mounted onto the downtube 10, engaging with the guide rods 16 and locating over the positioning pins 18 on the chain stopper 17. The body is provided with grab handles 22 to facilitate its handling by an ROV (remotely operated vehicle). The body also comprises an electrical power connection 23, a fibre optic data communication connection 24 for control and instrumentation communication with the tensioner, a hot stab receptacle 25 for emergency override as well as ROV operable valves 26 for override functions. The body further comprises a pair of hydraulic lift cylinders 27, the pistons of which are connected to rams connected to chain dogs 28 which are pivotally mounted to a yoke 29. A further hydraulic cylinder 30 is mounted to the yoke 29 and is operable to move the chain dogs 28 between extended and retracted positions. A pair of further hydraulic cylinders 31 is mounted towards the bottom of the body, arranged to operate the chain stopper release leaver 19 when the tensioner is mounted on the downtube.

Figure 10:
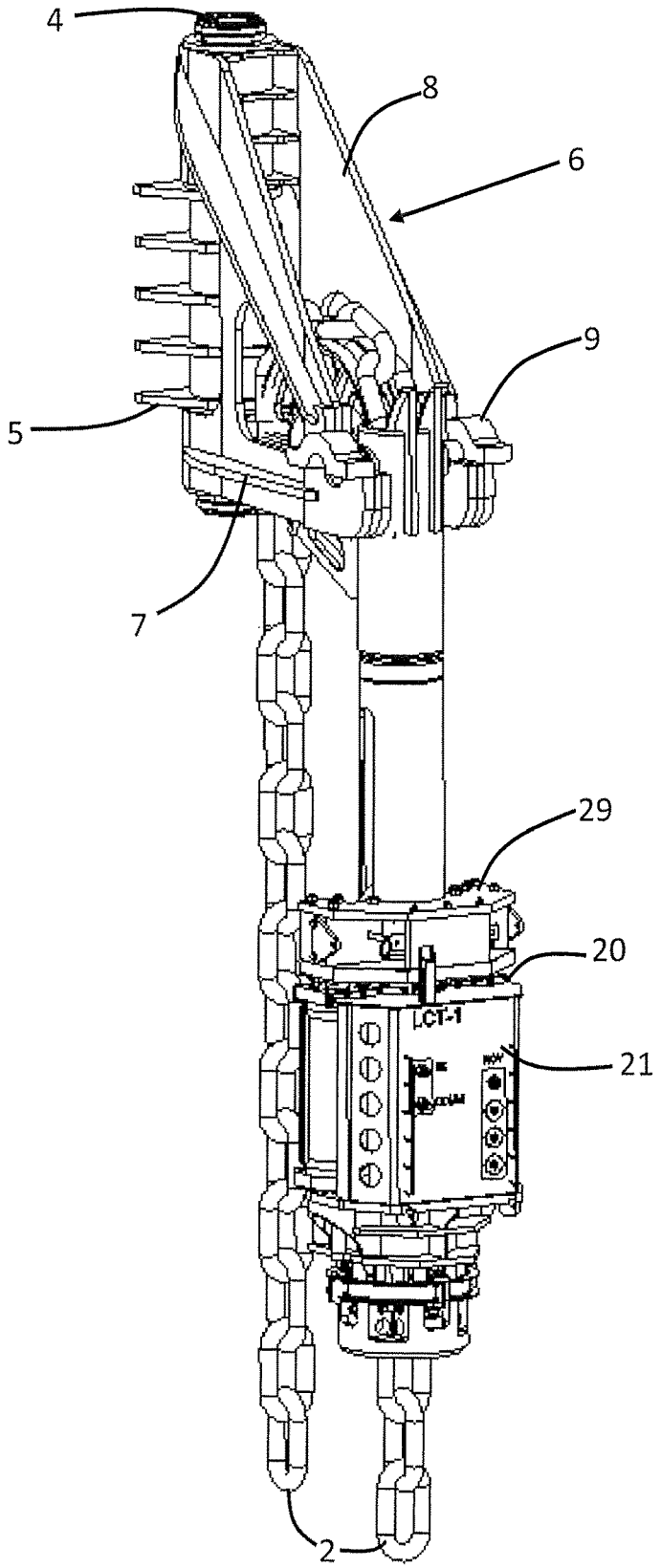
FIG. 10 is a corresponding view to FIG. 2 with the chain tensioner mounted to the mooring connector assembly.
Figure 11:
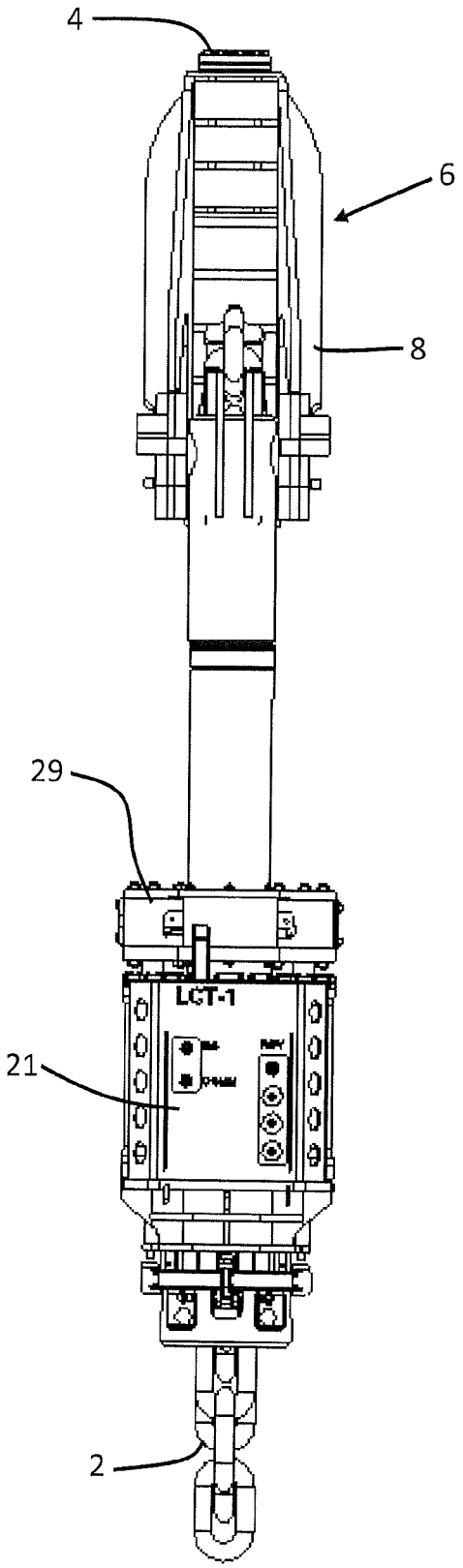
FIG. 11 is an end view of the apparatus shown in FIG. 10.

In use the tensioner 20 is mounted, as shown in FIGS. 10 and 11, on the downtube of a mooring connector assembly, with the bottom of the body 21 of the tensioner locating over the positioning pins 18 on the chain stopper. This places the hydraulic cylinders 31 adjacent the release lever of the chain stopper. It also places the yoke 29 adjacent the downtube so that the chain dogs 28 lie adjacent the bottom of the elongate slots 15 formed in the downtube 10. Connections are made to the power 23 and communication 24 connections from an umbilical, or via an ROV, to a control point to enable operation of the tensioner.

To tension the mooring chain cylinder 30 is activated to move the chain dogs 28 into their extended positions in which they extend into the elongate openings 15 in the downtube and contact the chain running in the downtube. The lift cylinders 27 are then operated, causing the yoke 29 to move from its home position closest the body 21 of the tensioner as shown in FIG. 10 towards an extended position, shown in FIG. 11. As the yoke 29 moves the chain dogs 28 engage with a link of the chain and lift and draw the chain through the chain stopper 17 and downtube 10. When one (or more, as desired and as the stroke of the lift cylinders and size of the chain permit) link(s) of chain 2 have been drawn through the chain stopper the lift cylinders are retracted. As the cylinders retract the chain will once again be supported by the chain stopper 17 with the dogs of the chain stopper supporting a link of the chain below that at which it was previously supported.

To slacken the mooring chain 2 the lift cylinders are partially extended before the chain dogs 28 are moved to the extended position. The lift cylinders are then further extended, sufficient to take the load of the chain 2 off the chain stopper 17. Then, cylinders 31 are operated to move the chain stopper release lever to move the chain dogs of the chain stopper away from the path of the chain, after which the lift cylinders are retracted to a point below their starting point allowing chain to pass down through the chain stopper. The chain stopper release lever is then released allowing the chain dogs of the chain stopper to move back into the path of the chain, and the lift cylinders retracted further allowing tension in the chain to be again taken up by the chain stopper. In the case the dogs of the chain stopper will now support the chain by a link above that at which the chain was previously supported.

After both tensioning and slackening operations the chain dogs on the yoke can be moved to the retracted position to enable the chain tensioner to be removed from the mooring assembly.

During both tensioning and slackening operations the chain is for a time supported by the chain dogs of the tensioner, rather than by the chain stopper. Throughout the operation, though, the chain maintains a substantially straight path from the sea bed to the chain stopper as the chain is always supported from a point below the axes about which downtube can pivot. Therefore tension in the chain continues to align the downtube such that the chain adopts a substantially straight path. This avoids stress concentrations in the chain, prolonging life of the chain.

The above embodiment is described by way of example only. Many variations are possible without departing from the scope of the invention as defined by the appended claims.

The invention claimed is:

1. A mooring connector assembly comprising:

a bracket arranged to be mounted to a structure to be moored;

a tube pivotally mounted to the bracket to be moored for movement about a pivot axis, at least a part of the tube extending below the pivot axis when so mounted and oriented for use, and a stopper mounted to the part of the tube which extends below the pivot axis in use and operative to retain a mooring line relative to the tube, wherein the tube is configured to receive a tensioner for tensioning a mooring line retained by the stopper such that the tensioner urges the line at a point which is below the pivot axis when the tube is oriented for use.

2. A mooring connector assembly as claimed in claim 1 wherein the part of the tube which extends below the pivot axis in use is configured to receive the tensioner.

3. A mooring connector assembly as claimed in claim 2 wherein the tube is configured to receive a tensioner in a position between the stopper and the pivot axis when the tube is oriented for use.

4. A mooring connector assembly as claimed in claim 1 wherein one end of the tube is arranged to be pivotally mounted to a structure, and the stopper is mounted to the opposite end of the tube.

5. A mooring connector assembly as claimed in claim 1 wherein the tube defines an internal space through which a mooring line extends, in use.

6. A mooring connector assembly as claimed in claim 5 wherein the tube comprises one or more openings into the internal space through which a tensioner may extend in use.

7. A mooring connector assembly as claimed in claim 1 wherein a line management structure is mounted to the tube.

8. A mooring connector assembly as claimed in claim 1 wherein the stopper is a chain stopper.

9. A mooring connector assembly as claimed in claim 1 wherein the bracket is arranged to be pivotally mounted to a structure to be moored.

10. A mooring connector assembly as claimed in claim 1 having a tensioner mounted thereon arranged to tension a mooring line retained by the stopper by urging the line at a point which is below the pivot axis when the tube is oriented for use.

11. A mooring connector assembly as claimed in claim 10 wherein the line tensioner is a chain jack.

12. A subsea buoy having a connector assembly in claim 1 mounted thereto.

* * * * *